United States Patent [19]

Longo et al.

[11] Patent Number: 4,734,973

[45] Date of Patent: Apr. 5, 1988

[54] METHOD FOR ASSISTING BRACELET ATTACHMENT

[76] Inventors: Paul Longo, 2210 Bay Ave., Ocean City, N.J. 08226; Nicholas Longo, 7 Farnwood Rd., Mt. Laurel, N.J. 08060; Chester Wiktorski, 237 Parkview Way, Newtown, Pa. 18940

[21] Appl. No.: 905,508

[22] Filed: Sep. 10, 1986

Related U.S. Application Data

[62] Division of Ser. No. 759,368, Jul. 26, 1985, Pat. No. 4,650,141.

[51] Int. Cl.[4] ..... B23P 11/00; B23P 19/00; B25B 1/20; B25B 27/14

[52] U.S. Cl. ..... 29/428; 29/281.1; 29/281.5; 29/283; 29/559; 29/700; 269/37

[58] Field of Search ..... 29/281.1, 281.5, 283, 29/559, 700, 428; 269/37, 139, 328, 41, 43, 47, 50, 51; 248/122

[56] References Cited

U.S. PATENT DOCUMENTS 2,896,890 7/1959 Hlavac ..... 269/51 X

*Primary Examiner*—P. W. Echols
*Assistant Examiner*—Ronald S. Wallace
*Attorney, Agent, or Firm*—Epstein & Edell

[57] ABSTRACT

A method for positionally stabilizing one end of a bracelet while the bracelet is being secured about the wrist includes a recessed receiver, a positive engagement clamp and a base portion with a flat stabilization surface. The receiver is in the form of a plate which is recessed to snugly receive the user's wrist. One end of the bracelet is forcefully engaged by the clamp at a location proximate the recess to prevent any movement of the clamped end of the bracelet while the two braclet ends are being engaged about the wrist. Positional stabilization of the overall device is provided by the flat stabilization surface which may be placed on a surface of an external support.

6 Claims, 1 Drawing Sheet

METHOD FOR ASSISTING BRACELET ATTACHMENT

CROSS REFERENCE TO RELATED APPLICATIONS

This application is a divisional application of U.S. patent application Ser. No. 06/759,368, filed July 26, 1985, now U.S. Pat. No. 4,650,141 issued Mar. 17, 1987.

BACKGROUND OF THE INVENTION

1. Technical Field

The present invention relates to devices useful for assisting an individual in securing a bracelet about his/her wrist.

2. Discussion of the Prior Art

A difficult task experienced by almost everyone involves the securing of a bracelet about his/her wrist. In this sense, and for purposes of the following description and claims, the term bracelet includes any jewelry item, wrist watch, etc., having two ends which must be engaged to secure the item about the wearer's wrist. Further, the term clasp is used herein to include snaps, buckles, clips, or other such mechanisms employed to secure opposite ends of bracelets. The aforementioned task is difficult for those having the nimblest of fingers and utmost dexterity; it may be impossible for the infirm. The problem centers about the fact that it is extremely difficult, given the physical limitations of human hands and fingers, to positionally stabilize one end of the bracelet while attempting to manuever the other end into a position wherein the two ends may be clasped together.

Prior art attempts to solve the problem described above are found in U.S. Pat. Nos. 3,016,589 (Collins) and 3,242,540 (Mitchell). Collins discloses a resilient clip designed to surround part of the wrist and having a hook at one end adapted to engage a loop or ring at one of the bracelet ends. This device can only be used with bracelets having a loop or ring at one end, thereby severely limiting the applicability of the device. Further, positional stability is not fully achieved for the end of the bracelet engaged by the device hook because the bracelet loop or ring can turn, slide and otherwise move on the hook. As a consequence, the clasping process is still quite difficult. Still further, for people who cannot hold their hands sufficiently steady, the location of the clip on the wrist, without additional positional stabilization of the clip, does not present a satisfactory solution to the problem.

The Mitchell patent discloses a device having a loop at one end adapted to engage a finger on the hand joined to the wrist about which a bracelet is to be secured. A rod extends from the device loop along the wearer's palm and terminates in a hook at the wearer's wrist. A loop or hook at one of the bracelet is engaged by the device hook when the bracelet is to be secured. This device also suffers from limited applicability to bracelets having a loop or hook at one end. In addition, the device hook permits movement of the engaged end of the bracelet. Finally, no positional stability of the overall device is provided, other than that provided by the user's own hands.

OBJECTS AND SUMMARY OF THE INVENTION

It is therefore an object of the present invention to provide a device of the type described which can be used with substantially any type of bracelet.

It is another object of the present invention to provide a device for assisting in securing a bracelet to a wrist wherein one end of the bracelet is completely positionally stabilized relative to the device.

Another object of the present invention is to provide a device for assisting in securing a bracelet to a wrist wherein the device itself may be positionally stabilized relative to an external support.

In accordance with one aspect of the present invention, one end of a bracelet is positionally stabilized with respect to an assistance device by means of a clamp for positively engaging that one end while the bracelet is being secured about the user's wrist. The clamp is capable of engaging an end of substantially any type of bracelet and, in the preferred embodiment, takes the form of two jaws which are spring-biased to a closed position and are selectively openable. The user's wrist is snugly received in a recess defined in an exposed edge of the device, and the clamp is secured adjacent the recess, preferably adjacent the mouth of the recess. The recess is defined in a plate which is oriented perpendicular to a base member having, in accordance with another aspect of the present invention, a flat surface adapted to be supported on a wall, table top, or similar external support to impart positional stability to the overall device. The flat base surface may be coated with adhesive to secure the base to the support.

BRIEF DESCRIPTION OF THE DRAWINGS

The above and still further objects, features and advantages of the present invention will become apparent upon consideration of the following detailed description of a specific embodiment thereon, especially when taken in conjunction with the accompanying drawings wherein like reference numerals in the various figures are utilized to designate like components, and wherein.

DESCRIPTION OF THE PREFERRED EMBODIMENT

Figure 1:
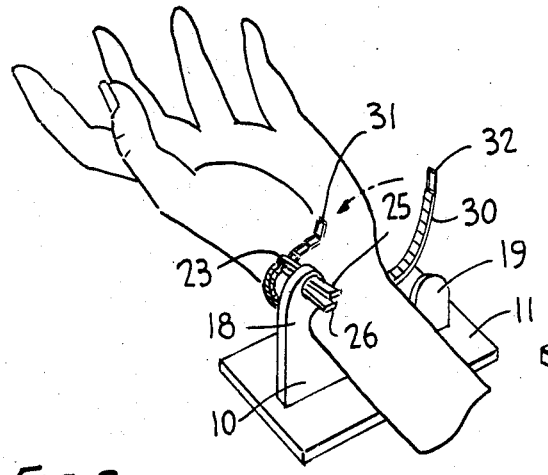
FIG. 1 is a view in perspective from the front showing the device of the present invention in use.
Figure 2:
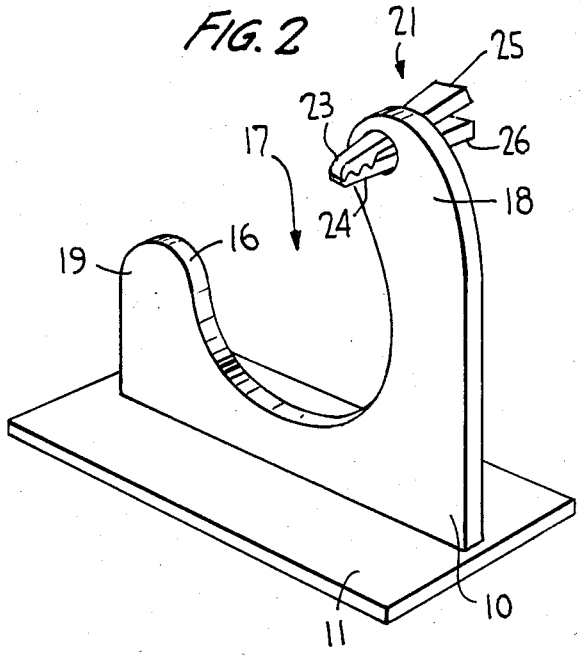
FIG. 2 is a view in perspective from the rear showing the device of FIG. 1.

Referring to the drawings in greater detail, the device of the present invention includes a plate member 10 having a straight edge secured to one surface of a base member 11. The opposite surface of base member 11 is a flat surface 12 which, in the illustrated and preferred embodiment, is coated with adhesive material 13. The adhesive material 13 is preferably provided with a removable backing in order to provide the user of the device with the option of using the adhesive or not. In either case, the bottom surface 12 provides positional stability for the overall device, in use, by placing surface 12 against a surface 14 of an external support 15. Support 15 may be a table or other item of furniture, a wall (in which case surface 12 would be vertically oriented), etc. In the preferred embodiment, flat surface 12 is oriented generally perpendicular to plate member 10.

Plate member 10 has an edge 16, remote from base member 11, in which a curved recess 17 is defined and configured to snugly receive a user's wrist in either a palm-up position (as illustrated in FIG. 1) or a palm-down position (not illustrated). Plate member 10, on opposite sides of recess 17, has two recess-defining projections 18 and 19 which project away from base member 11. The distal end of projection 18 extends approximately twice as far as the distal end of projection 19 from base member 11 in the preferred embodiment and has its concave recess-defining edge curved slightly toward projection 19. A mounting hole 20 is defined through projection 18 at the entrance to recess 17. Mounting hole 20 receives a clamp 21 extending axially through the hole and secured in place by a mounting pin 22 extending diametrically across hole 20 and through the clamp.

In the illustrated embodiment, clamp 21 takes the form of an alligator clip having two jaws 23, 24 pivotably mounted about mounting pin 22. The jaws 23, 24 extend through mounting hole 20 to one side of plate member 10, and their respective handle extensions 25, 26 extend to the opposite side of the plate member. A coiled bias spring 27 is disposed about pin 22 and biases the jaws 23, 24 tightly together in a closed position of the clamp. A user of the device can open the jaws by squeezing handles 25, 26 together against the bias force of spring 27.

Figure 3:
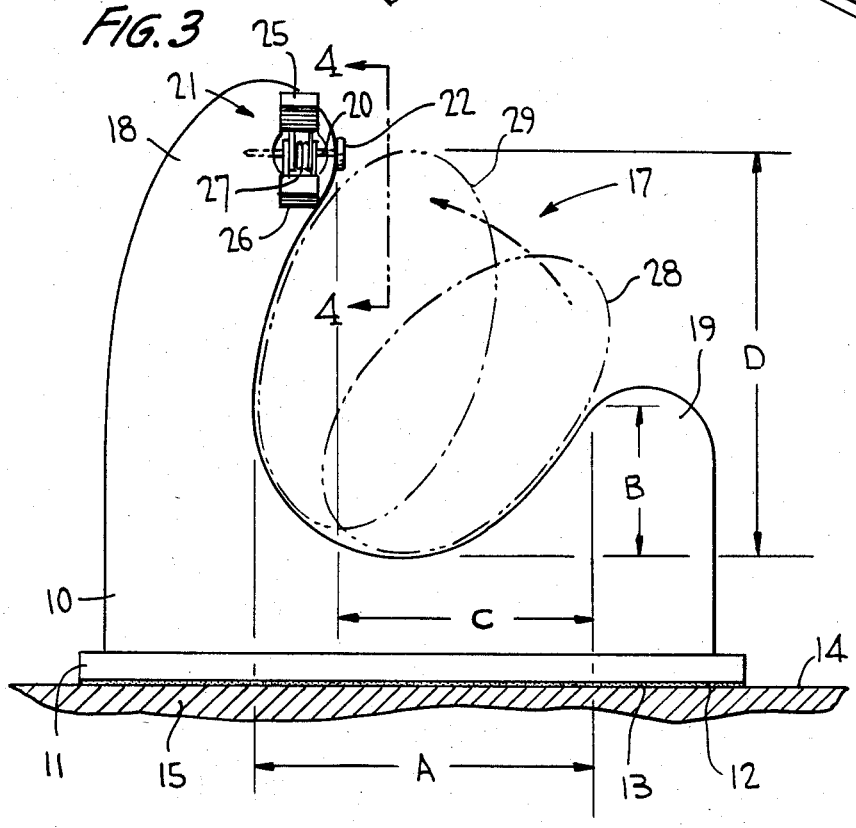
FIG. 3 is a front view in elevation of the device of FIG. 1.
Figure 4:
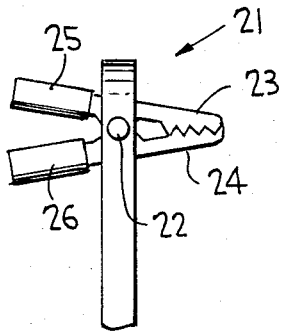
FIG. 4 is a side view taken along lines 4—4 of FIG. 3 showing the clamp mechanism in detail.

Recess 17 is generally U-shaped with the spacing between projections 18, 19 chosen to permit a snug fit on most adult human wrists. When a wrist is properly inserted, the recess 17 partially surrounds the wrist in a position which facilitates connection of the bracelet ends. In the preferred method of use of the device, an individual places his/her wrist in the recess adjacent projection 19 in the position diagrammatically illustrated by dashed lines 28 in FIG. 3. The inserted wrist is then rotated toward projection 18 and position 29 until the wrist is snugly engaged in the recess against projection 18.

Prior to inserting his/her wrist, the user clamps one end of a bracelet 30 (FIG. 1) between jaws 23, 24 of clamp 21. In most instances the clamp grips the bracelet at or near the clasp 31, although for some bracelets it may be more desirable to positionally stabilize the clasped end 32 rather than the clasp itself. Then, after the wrist is inserted into the recess 17, the clasp 31 and clasped end 32 are connected together. All throughout the procedure the flat surface 12 of base member 11 is flush against the support surface 14 and is held in place by adhesive coating 13 or by the force exerted toward base member 10 by the received wrist.

Plate member 10 and base member 11 may be made of plastic, metal, wood or any other rigid material. In the illustrated embodiment, plate member 10 is shown to be relatively thin (i.e., on the order of $\frac{3}{8}$ inch thick); however, a thicker plate may be employed, if desired. In a working model of the illustrated embodiment, the following recess dimensions, shown in FIG. 3, were found to be quite satisfactory and are listed here for purposes of example only: Dimension A (the transverse width of recess 17 from the entry point of the recess at projection 19 across to projection 18): $2\frac{1}{4}$ inches; Dimension B (the longitudinal depth of the recess from the same entry point at projection 19 to the longitudinally deepest point of the recess): 1 inch; Dimension C (the transverse dimension between the recess entry points at projections 18 and 19): $1\frac{3}{4}$ inches; and Dimension D (the length of the recess between the entry point at projection 18 and the longitudinally deepest point in the recess): $2\frac{5}{8}$ inches. The mounting hole 20 of the exemplary embodiment had a diameter of $\frac{1}{4}$ inch and was centered at a location $\frac{3}{8}$ inches transversely in from the recess entry point on projection 18.

It has been found that the location of mounting hole 20 and clamp 21 adjacent the recess entry point is extremely advantageous in facilitating the process of securing the bracelet to the inserted wrist. However, it is not crucial to the practice of the present invention that such location be employed. What is important, however, is that a clamp is used to positively grip one end of the bracelet to thereby positionally stabilize the bracelet relative to the device; and/or a surface, such as surface 12, is provided to positionally stabilize the device with respect to an external support.

Having described a preferred embodiment of a new and improved Device For Assisting Bracelet Attachment constructed in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A method of assisting an individual in applying a bracelet around a wrist of that individual, said method comprising the steps of:

(a) positionally stabilizing said wrist of the individual in a recess of a positionally stabilized wrist-receiving member;

(b) positionally stabilizing one end of said bracelet with respect to said wrist-receiving member at a location adjacent the positionally-stabilized wrist; and (c) securing the bracelet around said wrist by engaging the positionally stabilized one end of the bracelet with an opposite end of that bracelet.

2. The method according to claim 1 wherein step (b) includes the step of clamping said one end of said bracelet between two spring-biased members secured to wrist-receiving member.

3. The method according to claim 2 wherein step (a) includes stably positioning said wrist at a level below said location adjacent the positionally-stabilized wrist.

4. A method of assisting an individual in applying a bracelet around a wrist of that individual, said method comprising the steps of:

(a) positionally stabilizing said wrist of the individual with respect to a support surface;

(b) positionally stabilizing one end of said bracelet with respect to said support surface at a location adjacent the positionally-stabilized wrist and spaced from said support surface; and (c) securing the bracelet around said positionally-stabilized wrist by engaging the positionally-stabilized one end of the bracelet with the opposite end of that bracelet;

wherein step (a) includes the step of engaging said wrist in a wrist-receiving member while positionally stabilizing the wrist-receiving member against said support surface.

5. The method according to claim 4 wherein step (b) includes supporting said one end of said bracelet on said wrist-receiving member at said location adjacent the positionally-stabilized wrist.

6. The method according to claim 4 wherein said wrist-receiving member includes a recess, and wherein step (a) includes the step of disposing said wrist in said recess.

* * * * *